US006002905A

United States Patent [19]

Matsuda

[11] Patent Number: 6,002,905

[45] Date of Patent: Dec. 14, 1999

[54] BELT TRANSFER DEVICE FOR AN IMAGE FORMING APPARATUS

[75] Inventor: Itaru Matsuda, Yokohama, Japan

[73] Assignee: Ricoh Company, Ltd., Tokyo, Japan

[21] Appl. No.: 09/175,960

[22] Filed: Oct. 21, 1998

[30] Foreign Application Priority Data

Oct. 24, 1997 [JP] Japan ..... 9-292747

[51] Int. Cl.[6] ..... G03G 15/16; G03G 21/00

[52] U.S. Cl. ..... 399/303; 399/312

[58] Field of Search ..... 399/303, 299, 399/306, 312, 313, 316, 317

[56] References Cited

U.S. PATENT DOCUMENTS

| | | | |
|---|---|---|---|
| 5,189,479 | 2/1993 | Matsuda et al. . | |
| 5,481,461 | 1/1996 | Miyamoto et al. . | |
| 5,495,317 | 2/1996 | Matsuda et al. . | |
| 5,515,146 | 5/1996 | Harasawa et al. | 399/318 |
| 5,557,384 | 9/1996 | Takano et al. | 399/313 |
| 5,640,660 | 6/1997 | Takano et al. . | |
| 5,655,200 | 8/1997 | Oyama . | |
| 5,659,843 | 8/1997 | Takano et al. . | |
| 5,666,622 | 9/1997 | Harasawa et al. . | |
| 5,812,919 | 9/1998 | Takano et al. . | |
| 5,812,920 | 9/1998 | Mizude et al. | 399/316 |
| 5,822,667 | 10/1998 | Hayama et al. | 399/314 |

FOREIGN PATENT DOCUMENTS

| | | |
|---|---|---|
| 10-3222 | 1/1998 | Japan . |

*Primary Examiner*—Richard Moses

*Attorney, Agent, or Firm*—Oblon, Spivak, McClelland, Maier & Neustadt, P.C.

[57] ABSTRACT

A belt cleaning device included in an image forming apparatus for transferring a toner image from an image carrier to a recording medium and conveying the medium while electrostatically retaining it thereon is disclosed. The device allows its belt to be surely cleaned over the entire circumference even when electrostatic cleaning and image transfer share a single power source. The device therefore prevents the rear of the recording medium from being smeared.

9 Claims, 4 Drawing Sheets

BELT TRANSFER DEVICE FOR AN IMAGE FORMING APPARATUS

BACKGROUND OF THE INVENTION

The present invention relates to an electrophotographic copier, laser printer, facsimile apparatus or similar image forming apparatus. More particularly, the present invention is concerned with a belt transfer device for transferring a toner image from an image carrier to a recording medium and conveying the medium while electrostatically retaining it thereon and including a belt passed over a drive roller and a driven roller, charge applying means for applying a charge to the belt, a discharging member for discharging the belt, and a cleaning device for cleaning the surface of the belt.

In a belt transfer device of the type described, a bias for image transfer is continuously applied to a bias roller associated with a belt during copy mode operation. The bias deposits a charge opposite in polarity to the charge of toner deposited on a photoconductive drum on the belt having a preselected resistance. As a result, a toner image is transferred from the drum to a paper or similar recording medium. After the image transfer, cleaning means cleans the belt in order to remove the toner and impurities including paper dust.

The above cleaning means is generally implemented by a blade which is simple in configuration and low cost, as in the other image forming means. However, a problem is that a coating material having a small coefficient of friction and highly extendible cannot be easily selected for the blade in combination with the belt having elasticity. A hard material having a small coefficient of friction would form cracks in the surface of the belt and would allow toner to enter the cracks, resulting in defective cleaning. Moreover, highly extendible materials in general have great coefficients of friction and are apt to cause the blade to be turned up or to obstruct the separation of toner, also resulting in defective cleaning.

In light of the above, a current trend in the imaging art is toward a bias roller or similar electrostatic cleaning means replacing the blade. However, allocating a particular bias power source to each of electrostatic cleaning and image transfer is undesirable from the cost and space standpoint. To solve this problem, Japanese Patent Laid-Open Publication No. 8-76608, for example, teaches a system allowing electrostatic cleaning and image transfer to share a single power source. This system, however, brings about another problem that toner directly deposited on the belt is apt to partly remain even after cleaning unless due consideration is given to the OFF/OFF timing in relation to the shared bias power source.

Technologies relating to the present invention are also disclosed in, e.g., Japanese Patent Laid-Open Publication No. 10-3222.

SUMMARY OF THE INVENTION

It is therefore an object of the present invention to provide a belt transfer device allowing a belt to be fully cleaned over its entire circumference even when electrostatic cleaning and image transfer share a single bias power source, thereby preventing the rear of a paper from being smeared.

A belt transfer device for an image forming apparatus of the present invention includes a belt for conveying a recording medium to a position where the belt faces an image carrier. A transfer bias applying member is held in contact with the inner surface of the belt. An electrostatic cleaning member is positioned at the downstream side in the direction of rotation of the belt and held in contact with the outer surface of the belt for applying a bias to the belt. A mechanism is provided for selectively moving the belt into or out of contact with the image carrier. A high-tension power source is connected to the transfer bias applying member and connected to the electrostatic cleaning member by resistance division. A bias is continuously applied until, after the recording medium has moved away from the above position, a portion of the belt facing the image carrier when the belt is released from the image carrier moves away from at least the electrostatic cleaning member.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
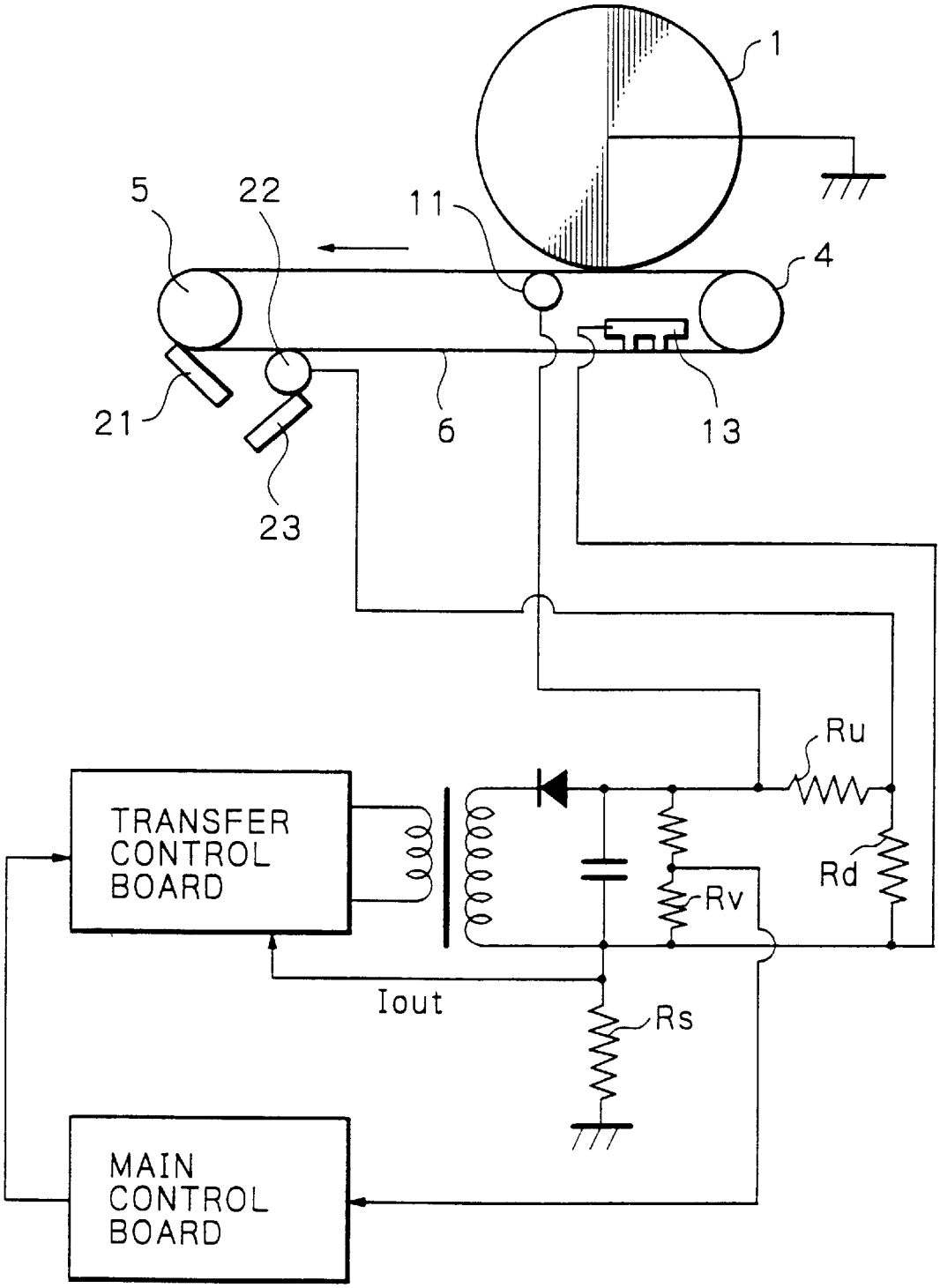
FIG. 1 shows the general construction of a belt transfer device embodying the present invention.

Referring to FIG. 1 of the drawings, a belt transfer device embodying the present invention is shown and implemented as a belt unit removably mounted to the body of an image forming apparatus. As shown, the belt unit includes a belt 6 passed over a pair of rollers 4 and 5 and to which a developed image is transferred from a photoconductive element or image carrier 1. The photoconductive element 1 is implemented as a drum. A DC solenoid and a lever, not shown, selectively move the belt 6 into or out of contact with the drum 1 and constitute moving means in combination. A bias roller 11 applies a bias for image transfer to the belt 6. A contact plate 13 dissipates charge deposited on the belt 6. The body of the image forming apparatus includes a cleaning device including a cleaning blade for scraping off toner left on the belt 6 after image transfer and a high-tension power source for applying a voltage to the bias roller 11, as will be described in detail later.

The roller 5 is connected to a drive motor, not shown, via a gearing and plays the role of a drive roller. The drive roller 5 is formed of EPDM rubber, chloroprene rubber or silicone rubber in order to surely grip the belt 6. The other roller or driven roller 4 is tapered at both axial ends thereof so as to prevent the displacement of the belt 6 in the lateral direction. While the driven roller 4 is formed of conductive metal, it is not electrically connected to any conductive member, but simply supports the belt 6 constituting an electric resistance.

The belt 6 is caused to rotate counterclockwise by the drive roller 5, conveying a paper or similar recording medium to a position where the belt 6 and drum 1 face each other. The belt 6 has, e.g., a double-layer structure consisting of an outer layer or surface layer and an inner. The outer layer has a surface resistivity of $1\times10^{9}\Omega$ to $1\times10^{12}\Omega$ while the inner layer has a surface resistivity of $1\times10^{7}\Omega$ to $1\times10^{9}\Omega$, as measured by applying DC 100 V in accordance with JIS (Japanese Industrial Standards K6911. The belt 6 has a volume resistivity of $5\times10^{8}\Omega\cdot$cm to $5\times10^{10}\Omega\cdot$cm. In this sense, the belt 6 has a so-called medium resistance.

The bias roller 11 is positioned downstream of the driven roller 4 in the direction of movement of the belt 6 and held in contact with the inner surface of the belt 6. The bias roller 11 is connected to a high-tension power source and serves as a contact electrode for applying to the belt 6 a charge opposite in polarity to the charge of toner deposited on the drum 1. The contact plate 13 is held in contact with the inner surface of the lower run of the belt 6 in the vicinity of the driven roller 4. The contact plate 13 reduces the injection of a charge into the paper at a position upstream of the nip between the belt 6 and the drum 1 in the direction of movement of the drum 6. Also, the contact plate 13 senses a current flowing to the belt 6 as a feedback current. A current to be fed from the bias roller 11 is controlled in accordance with the current sensed by the contact plate 13. For this purpose, an image transfer control board is connected to the contact plate 13 for setting a current to be fed to the bias roller 11, as illustrated. The image transfer control board is connected to the high-tension power source. If desired, the contact plate 13 may be held in contact with the belt 6 at any other suitable position, e.g., a position adjoining the drive roller 5.

The cleaning unit for cleaning the surface of the belt 6 has a main cleaning mechanism including a cleaning blade 21 formed of polyurethane. The cleaning blade 21 scrapes off toner and impurities, including paper dust, left on the belt 6 after image transfer. The cleaning unit additionally has an auxiliary cleaning mechanism including a bias roller or cleaning member 22 using an electric field. The bias roller 22 electrostatically removes the toner and impurities which the cleaning blade 21 has failed to remove. A cleaning bias power source applies a preselected voltage to the bias roller 22. Another cleaning blade 23 removes the toner and impurities from the bias roller 22. The bias roller 22 may be connected to the drive roller 5 by, e.g., a gearing and driven by the drive roller 5 by way of example.

The above cleaning bias is implemented by circuitry shown in FIG. 1 and including a single power source. As shown, a rectifying circuit made up of a diode and a capacitor is connected to the secondary winding of a boosting transformer included in an image transfer power source. The bias roller or image transfer electrode 11 is connected to the high voltage side of the rectifying circuit. The low voltage side of the rectifying circuit is connected to ground via a resistor or current sensing means Rs and connected to a drive circuit included in the image transfer control board. In this configuration, a feedback signal is fed from the rectifying circuit to the drive circuit of the image transfer control board. A voltage dividing circuit made up of resistors Ru and Rd is connected to the opposite ends of the rectifying circuit. The bias roller or cleaning electrode 22 is connected to the voltage division point between the resistors Ru and Rd. The resistors Ru and Rd therefore divide the bias to be applied to the bias roller 11 in parallel and thereby produce the cleaning bias. The resistor Rs senses a transfer current $I_{out}$ flowing to the drum 1 and transforms it to a corresponding voltage. The image transfer control board executes constant current control in accordance with the current $I_{out}$ fed back thereto. A resistor Rv senses the bias voltage for image transfer. The output voltage of the resistor Rv is input to a main control board, as illustrated. In response, the main control board executes limiter control in order to prevent the above bias voltage from exceeding a preselected value. In the illustrative embodiment, the limiter control is effected with a limiter voltage of −6.5 kV.

A specific operation of the illustrative embodiment will be described with reference to FIG. 2. As shown, after a paper has moved away from the nip between the drum 1 and the belt 6, the DC solenoid is deenergized in order to release the belt 6 from the drum 1. Thereafter, the bias output (image transfer and cleaning) is turned off on the elapse of a period of time t. The period of time t is selected to be longer than the period of time necessary for the portion of the belt 6 released from the drum 1 to move away from the cleaning bias roller 22. This allows the bias roller 22 to surely clean the area of the belt 6 which may contact the drum 1 and be smeared by toner deposited on the drum 1. Further, because the belt 6 is released from the drum 1, the transfer current $I_{out}$ is zero during the above period of time t due to the constant control based on the current $I_{out}$. It follows that as for control, correction is so effected as to cause a current to continuously flow. As a result, substantially the limiter voltage of −6.5 kV is output.

Figure 2:
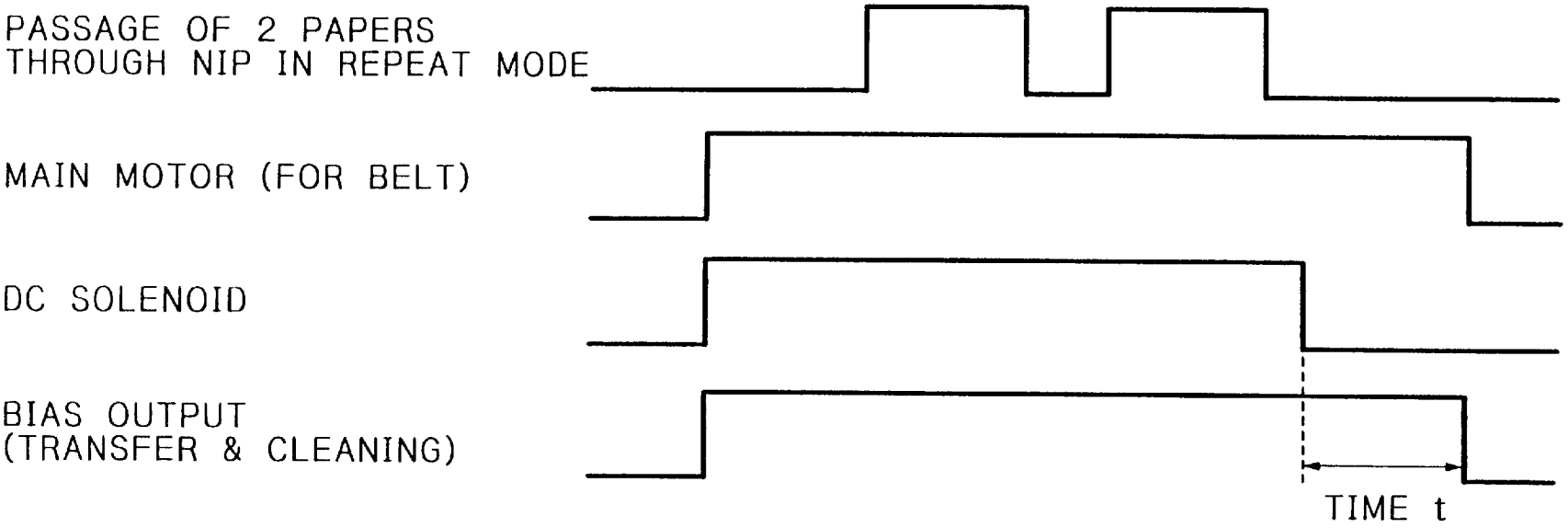
FIGS. 2 and 3 are timing charts each showing a particular specific operation of the illustrative embodiment.
Figure 3:
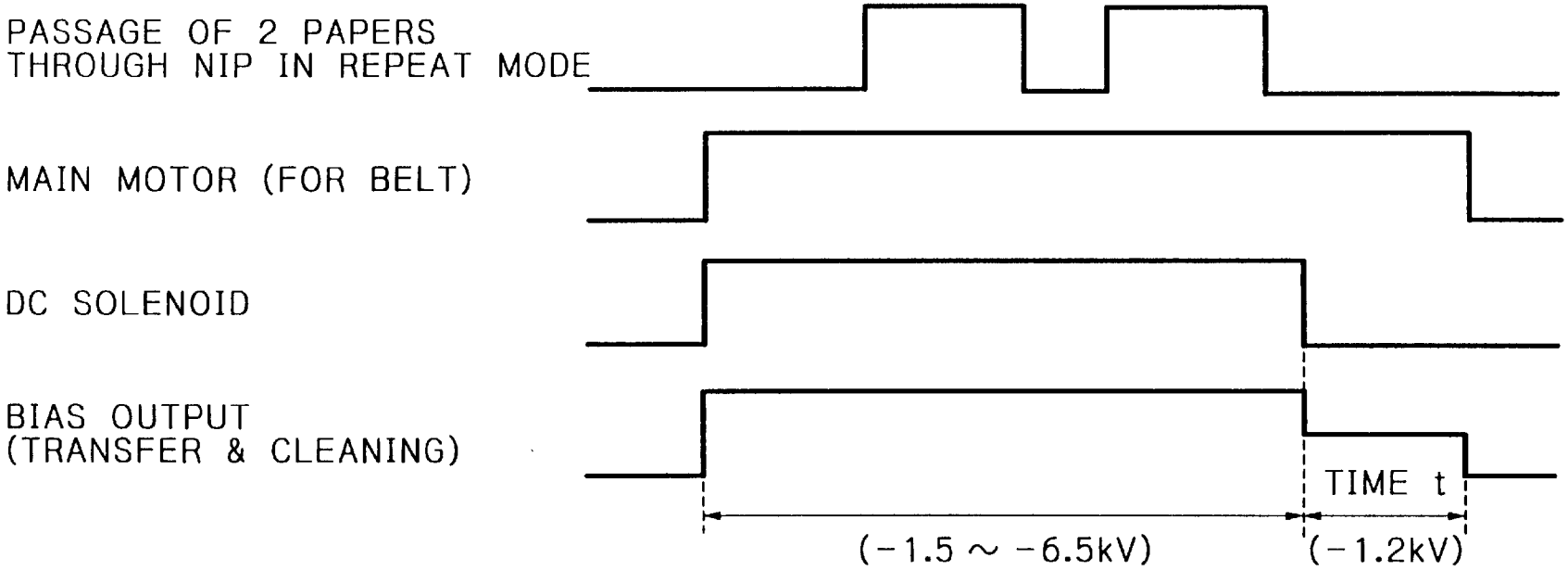
Figure 4:
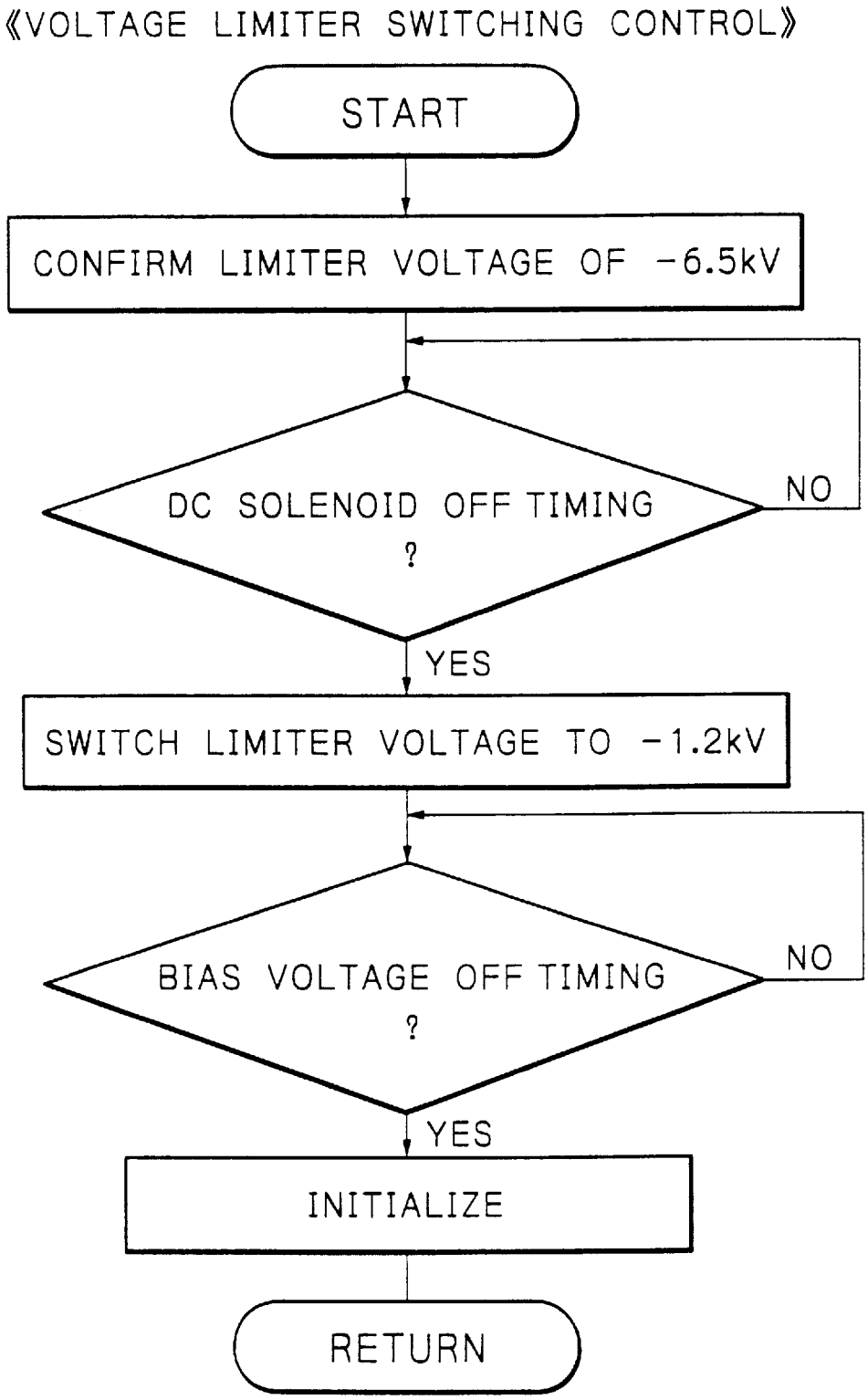
FIG. 4 is a flowchart associated with FIG. 3.

FIG. 3 demonstrates another specific operation of the illustrative embodiment. As shown, the procedure of FIG. 3 differs from the procedure of FIG. 2 in that at the same time as the DC solenoid is turned off, the limiter value of the voltage limiter control assigned to the main control board and therefore the bias output is switched. Specifically, the bias output is lowered during the period of time t. More specifically, the voltage limiter control is selectively effected with either one of two limiter voltages, as follows. Usually, the limiter voltage of −6.5 kV is set; during usual copying, the constant current control based on the transfer current $I_{out}$ is executed in the range of the bias voltage between −1.5 kV and −6.5 kV. At the same time as the DC solenoid is turned off, the limiter voltage is switched from −6.5 kV to −1.2 kV. As a result, the constant current control occurs with the bias voltage of −1.2 kV during the period of time t. Such a procedure is shown in FIG. 4 in a flowchart.

The procedures shown in FIGS. 2 and 3 each releases the belt 6 from the drum 1 and prevents −6.5 kV or similar high voltage from being applied to the bias roller 11. This obviates an occurrence that, e.g., spark discharge is directed from the high voltage portion of the belt 6 toward the low resistance portion of the drum 1 where an aluminum base is exposed, e.g., pin holes, causing the apparatus to malfunction. At the same time, a bias voltage necessary for cleaning is guaranteed and allows the belt 6 to be cleaned over its entire circumference. Particularly, during the period of time t, the lowered voltage stabilizes the electric field for cleaning between the bias roller 22 and the belt 6 and thereby stabilizes the cleaning ability.

Because the illustrative embodiment executes constant current control based on the transfer current $I_{out}$, it switches the bias output or executes constant voltage control by using limiter control. Alternatively, there may be effected constant voltage control over a high-tension power source or the direct switching of an output value with a power source subjected to constant current control with respect to the total current.

In summary, it will be seen that the present invention provides a belt transfer device for an image forming apparatus allowing a belt to be surely cleaned over its entire circumference even when electrostatic cleaning and image transfer share a single power source. The device therefore protects the rear of a paper from smearing. Further, at the time of cleaning following image transfer, there can be obviated spark discharge (leak) apt to occur from the belt released from an image carrier toward pin holes or similar low resistance portions of the image carrier. In addition, priority is given to constant image transfer current during image transfer or to a constant electric field for cleaning after image transfer, so that both of the image transfer ability and cleaning ability are further stabilized.

Various modifications will become possible for those skilled in the art after receiving the teachings of the present disclosure without departing from the scope thereof.

What is claimed is:

1. A belt transfer device for an image forming apparatus, comprising:

a belt for conveying a recording medium provided on said belt to a position facing an image carrier;

a transfer bias applying device contacting an inner surface of said belt;

an electrostatic cleaning device, positioned at a downstream side in a direction of travel of said belt and contacting an outer surface of said belt, configured to apply a bias to said belt;

moving means for selectively moving said belt into or out of contact with said image carrier; and a high-tension power source connected to said transfer bias applying device and connected to said electrostatic cleaning device by resistance division;

wherein, after said moving means moves said belt out of contact with said image carrier, said electrostatic cleaning device continuously applies a bias to said belt for a time at least as long as a time necessary for a portion of said belt facing said image carrier when said belt is moved out of contact with said image carrier to travel past said electrostatic cleaning device.

2. A device as claimed in claim 1, wherein a bias output when said belt remains in contact with said image carrier and a bias output until said portion of said belt travels past said electrostatic cleaning means are different from each other.

3. A device as claimed in claim 2, wherein the bias output until said portion of said belt travels past said electrostatic cleaning means is lower than the bias output when said belt remains in contact with said image carrier.

4. A device as claimed in claim 2, wherein the bias output when said belt remains in contact with said image carrier is subjected to constant current control while the bias output until said portion of said belt travels past said electrostatic cleaning means is subjected to constant voltage control.

5. A method for transferring an image from an image carrier to a recording medium, comprising the steps:

conveying a recording medium provided on a belt to a position facing an image carrier;

selectively moving said belt into or out of contact with said image carrier; and, applying a bias to said belt for a time at least as long as a time necessary for a portion of said belt facing said image carrier when said belt is moved out of contact with said image carrier to travel past a cleaning device.

6. The method of claim 5, wherein said step of applying a bias comprises:

applying a first bias when said belt remains in contact with said image carrier; and, applying a second bias different than said first bias during the period of time necessary for said portion of said belt facing said image carrier when said belt is moved from said image carrier to travel past said cleaning device.

7. The method of claim 6, wherein said step of applying a second bias comprises:

applying a bias having a lower output than said first bias.

8. The method of claim 6, wherein said step of applying a first bias comprises:

applying a bias subjected to constant current control.

9. The method of claim 8, wherein said step of applying a second bias comprises:

applying a bias subjected to constant voltage control.

* * * * *